US007177566B2

(12) United States Patent
Noda et al.

(10) Patent No.: US 7,177,566 B2
(45) Date of Patent: Feb. 13, 2007

(54) MAIN FRAME CONSTRUCTION FOR AN IMAGE FORMING APPARATUS

(75) Inventors: Shinya Noda, Shizuoka (JP); Takeshi Niimura, Kanagawa (JP); Ken Murooka, Shizuoka (JP); Takaaki Kawade, Kanagawa (JP); Hideki Miyazaki, Shizuoka (JP); Yasuzumi Taba, Shizuoka (JP); Atsushi Oguni, Shizuoka (JP); Tatsuo Hamada, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 10/928,091

(22) Filed: Aug. 30, 2004

(65) Prior Publication Data

US 2005/0069340 A1 Mar. 31, 2005

(30) Foreign Application Priority Data

Aug. 29, 2003 (JP) ..... 2003-307837

(51) Int. Cl.
*G03G 15/00* (2006.01)

(52) U.S. Cl. ..... 399/107; 399/110

(58) Field of Classification Search ..... 399/107, 399/110, 113, 114, 116, 117, 124, 125
See application file for complete search history.

(56) References Cited

U.S. PATENT DOCUMENTS 5,899,601 A * 5/1999 Yamaguchi et al. ..... 399/110
6,021,290 A 2/2000 Hamada et al. ..... 399/92
6,300,970 B1 10/2001 Hamada et al. ..... 347/264
6,381,425 B2 * 4/2002 Sasai ..... 399/66
6,466,753 B2 * 10/2002 Kida ..... 399/107
6,636,338 B1 * 10/2003 Kida et al. ..... 359/196
6,928,251 B2 * 8/2005 Yoshihara et al. ..... 399/107

FOREIGN PATENT DOCUMENTS

JP 7-301965 11/1995
JP 2001-97590 4/2001

* cited by examiner

*Primary Examiner*—Hoan Tran
(74) *Attorney, Agent, or Firm*—Fitzpatrick, Cella, Harper & Scinto

(57) ABSTRACT

An image forming apparatus includes: a conveying unit for conveying a recording material on which an image is to be formed; and a pair of side members provided on both sides of the recording material conveyed by the conveying unit, in which the pair of side members each have a first surface portion and a second surface portion that extends in a direction different from the first surface portion, the first surface portion of one of the pair of side members being opposed to that of the other, and in which the conveying unit is attached to the second surface portion of each of the pair of side members, whereby the maintenance property of the conveying unit for conveying the recording material is improved.

14 Claims, 10 Drawing Sheets

MAIN FRAME CONSTRUCTION FOR AN IMAGE FORMING APPARATUS

BACKGROUND OF THE INVENTION

1. Field of the Invention

The present invention relates to an image forming apparatus for forming an image on a recording material, such as a copying machine, a printer, and a facsimile.

2. Related Background Art

FIGS. 7 and 8 show a construction of a laser beam printer 100 as an example of an image forming apparatus employing an electrophotographic process or other such recording process.

In a laser beam printer, a convey path R is generally set substantially horizontally as shown in FIG. 7, or obliquely as shown in FIG. 8. The convey path R begins at the position of recording material supplying means, which includes a tray on which a recording materials such plain paper can be stacked, and a roller for feeding the recording material into the laser printer from the tray; the recording material in the convey path R is conveyed by way of transferring means for transferring a developed image to the recording material, before reaching fixing means for fixing the developed image on the recording material by heating.

In the laser beam printer 100, a sheet feeding tray 1 and a sheet feeding roller 2 are arranged on one end side (the right-end side in FIGS. 7 and 8) of the convey path R, and a transferring roller 9 is arranged substantially in the middle of the convey path R, with a fixing device 11 as fixing means arranged on the other end side (the left-end side in FIGS. 7 and 8) of the convey path R. Those members are arranged in a substantially straight line, and image forming means such as a process cartridge 7 and optical means such as a laser scanner 5 are arranged above the convey path R.

The feeding of a recording material P, transferring of a developed image (toner image) to the recording material P, and fixing of the developed image on the recording material P are successively performed by those respective means. Then, the recording material P is conveyed by way of a discharge roller pair 12 with its printing surface facing down, to reach a discharge tray 14.

The fixing device 11 and the laser scanner 5 described above are fixed to a main frame F shown in FIGS. 9 and 10 which functions as a frame member.

The main frame F shown in FIG. 9 is made of resin, in which left and right side walls f1 and f2, and connecting portions f3 and f4 connecting the two side walls to each other, are formed through integral molding. The connecting portion f4, which is obliquely set, functions as the convey path R.

Further, the main frame F shown in FIG. 10 has left and right side plates F1 and F2, and connecting members F3, F4, and F5 connecting the two side plates to each other. Those members F1 to F5 are joined together to form the main frame F. In this case as well, the obliquely set connecting member F4 is endowed with a function as the convey path R.

The side plates F1 and F2, and the connecting member F3 and F5 are each made of sheet metal, whereas the connecting member F4 is made of insulating resin. This is because the connecting member F4 is implemented as a portion supporting the transferring means 9 mentioned above. That is, to prevent leakage of a transfer bias, it is preferable to use an insulating resin having an electrical insulating property for such a connecting member F4.

Incidentally, the main frame F forms the frame structure of the laser beam printer, and thus has a size not very different from that of the main body. Accordingly, when, as described in FIG. 9, the main frame F is to be formed of resin through integral molding, not only is a large-sized molding machine necessary, it takes time to fill a molten resin, which serves as a forming material, into the mold, and also to cool the filled molten resin.

Further, numerous limitations apply in the molding of the main frame F due to the shapes of its components, which makes the degree of freedom of design rather low.

In addition, as the configuration of the main frame becomes complex, not only does it take a long time to prepare a forming mold for the main frame, it also drives up cost. Further, there is also the problem of the maintenance of such a forming mold.

In this regard, the above-mentioned problems can be overcome when the main frame F is formed by joining mainly sheet metal members such as those described in FIG. 10.

However, as can be seen in FIG. 10, the connecting member F4 is situated between the connecting members F3 and F5 as seen in the vertical direction, and fixed in place while sandwiched between the left and right side plates F1 and F2 in this state. Accordingly, when maintenance or repair is to be performed on parts mounted to the connecting member F4, it is rather difficult to take out the connecting member F4 from the main frame F, resulting in poor workability.

Further, to perform maintenance or repair on the parts mounted to the connecting member F4, it is necessary to remove the connecting member F3, for example. In this regard, the connecting member F4 and the connecting member F3 are mounted at right angles with respect to the respective main surfaces of the side plates F1 and F2 to which they are mounted, with their weights being balanced in this state with those of the components mounted to the main frame F. Accordingly, when the connecting members F3 and F4 are removed, such a balance is destroyed, causing a reduction in the mechanical strength of the apparatus. Therefore, the apparatus may actually deform when applied with some external force during the maintenance or repair.

Further, when there is a large distance between the fixing device 11 and the discharge tray 14, it is necessary to provide a discharge/convey guide 15 for conveying the recording material from the fixing device 11 to the discharge tray 14, leading to such problems as the increased number of parts, enlarged size of the apparatus, and increased discharge time for the recording material.

SUMMARY OF THE INVENTION

It is an object of the present invention to provide an image forming apparatus with improved maintenance property of conveying means for conveying a recording material.

It is another object of the present invention to provide an image forming apparatus including: conveying means for conveying a recording material on which an image is to be formed; and a pair of side members provided on both sides of the recording material conveyed by the conveying means, in which each of the pair of side members has a couple of first surface portions and a second surface portion, one of the first surface portions and the other of the first surface portions are opposed with each other, the second surface portion extending in a direction different from the first surface portion, and in which the conveying means is attached to the second surface portion of each of the pair of side members.

Further objects of the present invention will become apparent from the following description of the present invention.

DESCRIPTION OF THE PREFERRED EMBODIMENTS

Hereinbelow, an embodiment of the present invention is described with reference to the drawings.

Figure 1:
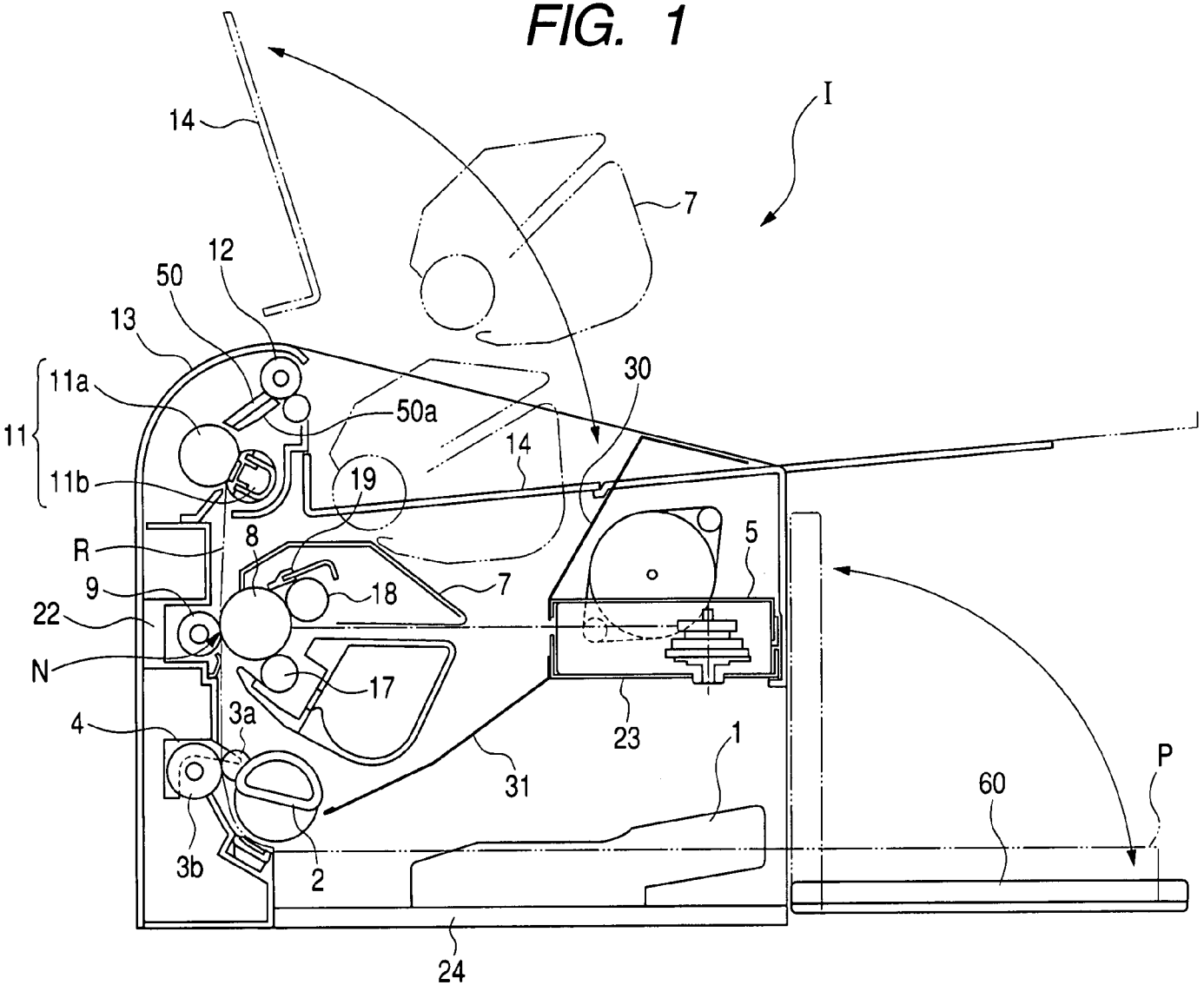
FIG. 1 is a cross sectional view of an image forming apparatus according to an embodiment of the present invention.

FIG. 1 is a cross sectional view showing a laser beam printer I as an image forming apparatus according to the present invention.

The laser beam printer I adopts an electrophotographic process in which laser light is emitted to a photosensitive member 8 provided inside an apparatus main body, thus laser-scanning the photosensitive member 8 for image recording.

In FIG. 1, reference numeral 1 denotes a sheet feeding tray serving as a recording material containing means. Multiple sheets of a recording material P are stacked on the sheet feeding tray 1.

By a sheet feeding roller 2 arranged on the left side (the deeper part of the apparatus) of the sheet feeding tray 1 and serving as a recording material supplying device, the recording material P is supplied, starting at the position of the sheet feeding roller 2, into the apparatus main body while being separated into single sheets of recording material, and conveyed by convey rollers 3*a* and 3*b* located diagonally above the sheet feeding roller 2 to a transfer part N where the photosensitive member 8 and a transferring roller 9 are held in contact with each other. The transferring roller 9 serves as transferring means for transferring a developed image (toner image) from the photosensitive member 8 to the recording material P. It is to be noted that the sheet feeding tray 1 and the sheet feeding roller 2 are collectively referred to as recording material supplying means for supplying the recording material into the apparatus.

Further, reference numeral 4 denotes a registration sensor for synchronizing the leading edge position of the recording material P with the light-emitting timing of a laser scanner 5 serving as an exposure light source, thus effecting image drawing from a predetermined position on the recording material P.

Further, reference numeral 7 denotes a process cartridge. The process cartridge 7 is constructed by integrating process means including the photosensitive member 8 serving as an image bearing member, a developing device 17 including a developer-carrying member, a charging roller 18, a cleaner 19, and the like, and is detachably mounted to the apparatus main body.

The toner image on the photosensitive member 8 is then transferred onto the recording material P by the transferring roller 9. The recording material P thus bearing an unfixed toner image undergoes fixing by a fixing device 11 so that the unfixed toner image is fixed onto the recording material P under heat and pressure.

As shown in FIG. 1, the sheet feeding roller 2, the transferring roller 9, and the fixing device 11 are arranged in a substantially vertical, straight line.

The fixing device 11 includes a pressure roller 11*a* and a heater unit 11*b*. While heat is generated from the heater unit 11*b* in the fixing device 11, the fixing device 11 is located in the vicinity of a louver portion (not shown) arranged in the uppermost portion of an outer cover 13, so that heat is easily discharged from the fixing device 11 to the outside of the apparatus. Since the heat travels upward, the process cartridge 7 and the laser scanner 5 that are arranged below or at the side of the fixing device 11 are not affected by the heat generated from the fixing device 11, making it possible to obtain a favorable output image at all times.

The recording material P having the toner image thus fixed thereon then comes into abutment with a rib 50*a* of a discharge guide 50 before being discharged, with its printed side facing down, to a discharge tray 14 by a discharge roller pair 12. It is to be noted that the discharge tray 14 is formed integrally with the outer cover 13.

As described above, the nip part of the fixing device 11 including the heater unit 11*b* and the pressure roller 11*a* is arranged at an incline such that the heater unit 11*b* side is situated at a lower position with respect to the pressure roller 11*a*. As the recording material P passes through the fixing device 11, the recording material P is bent toward the print surface side with respect to a convey path R. Accordingly, a large inclination can be set for the discharge guide 50 with respect to the convey path R, making it possible to suppress the height length from the fixing device 11 to the discharge roller pair 12 and shorten the distance of the convey path R.

As a result, the discharge guide 50 may be made compact, since it suffices that the discharge guide 50 be of a size which allows it to be accommodated inside a fixing frame 25 (see FIG. 5) that supports the fixing means 11.

Further, the convey guide for the recording material P which is to be directly attached on a main frame F may be constituted solely by a conveying member 22 serving as conveying means and forming the convey path R that begins at the position of the recording material supplying means (the sheet feeding tray 1 and the sheet feeding roller 2) for supplying the recording material P into the apparatus, and extends by way of the transferring means 9 for transferring a toner image onto the recording material P, ending at the position of the fixing means 11 for fixing the toner image on the recording material P to the recording material P. In other words, the recording material P can be conveyed from the position of the sheet feeding tray to the fixing position by the conveying member 22 alone.

Further, the distance of the convey path R is short, making it possible to downsize the conveying member 22. Not only does this enable a reduction in the parts cost of the conveying member 22, but also a small forming mold suffices for molding of the conveying member 22, providing such advantages as the reduced time for preparing the mold, restrained cost of the mold, and reduced cost associated with reduced molding time.

Figure 2:
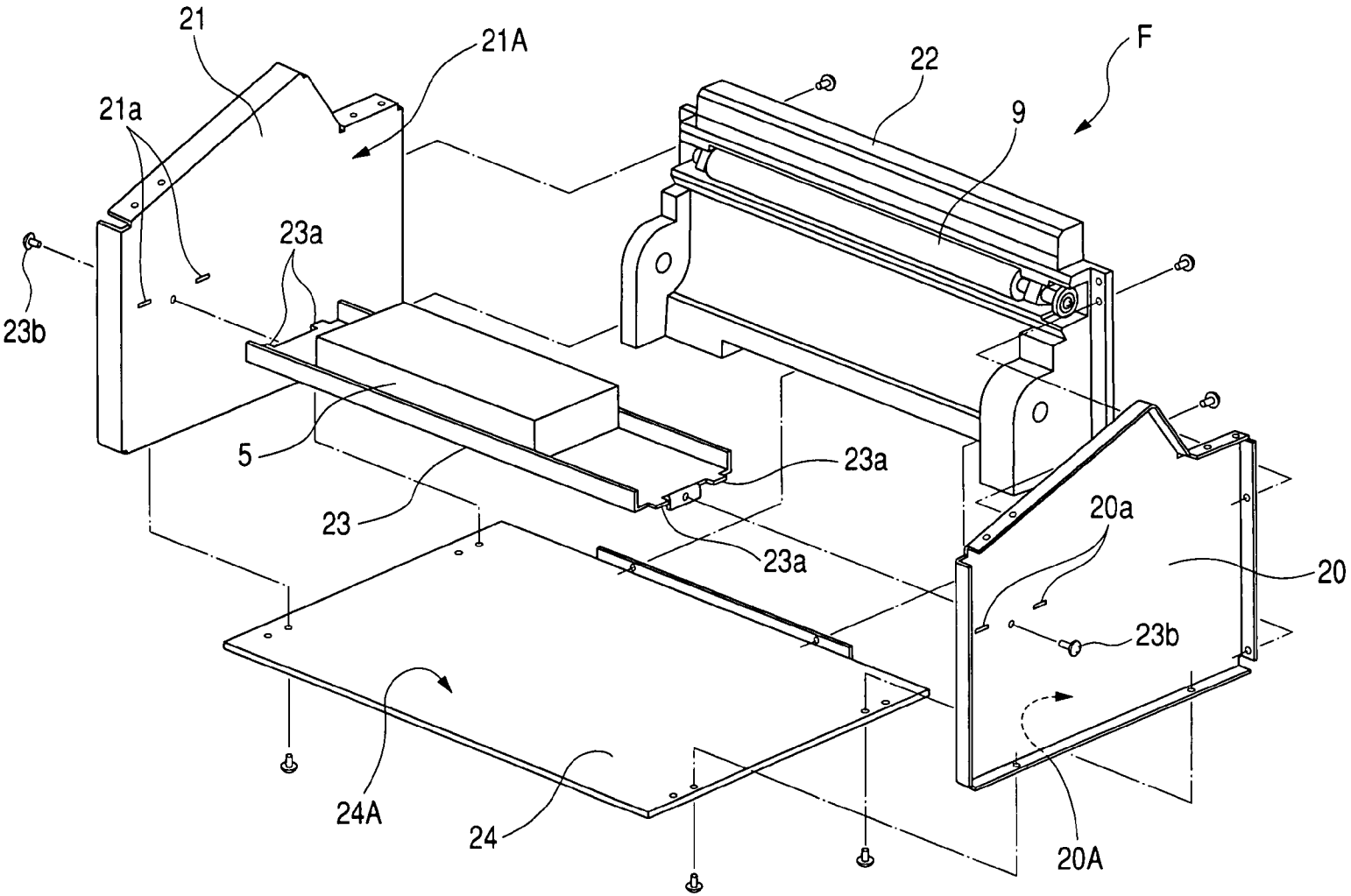
FIG. 2 is an exploded perspective view of a main frame constituting an apparatus main body as seen from the above.

Further, as shown in FIG. 2, the main frame F is constructed by joining together five parts consisting of: side plates 20 and 21 serving as a pair of left and right side members arranged in an opposed relationship on both sides of the conveying member 22 and made of sheet metal; the conveying member 22 constituting the above-mentioned convey path R, the conveying member 22 retaining the sheet feeding roller 2, the convey rollers 3*a* and 3*b*, and the transferring means (transferring roller) 9, which are rotary members as described above, and made of resin; and an optical stay 23 located on the side opposite to the conveying member 22 and serving as a connecting member connecting between the above-mentioned side plates 20 and 21, the optical stay 23 being made of sheet metal and retaining the laser scanner 5; and a rectangular bottom plate 24 made of sheet metal and to which the sheet feeding tray 1 is attached. Further, the conveying member 22, which is made of an electrical insulating resin, is attached onto the end portions of the side plates 20 and 21 and arranged in a substantially vertical direction with respect to the bottom plate 24 serving as a bottom member.

As shown in FIGS. 2 to 6, the side plates 20 and 21 respectively include first surface portions 20A and 21A that are opposed with each other, and second surface portions 20B and 21B, third surface portions 20C and 21C, fourth surface portions 20D and 21D, and fifth surface portions 20E and 21E, each extending in directions different from the first surface portions 20A and 21A. The second surface portions 20B and 21B, the third surface portions 20C and 21C, the fourth surface portions 20D and 21D, and the fifth surface portions 20E and 21E are each bent in a direction substantially orthogonal to the first surface portions 20A and 21A.

As shown in FIG. 2, protrusions 23*a* of the optical stay 23 are fitted in positioning holes 20*a* and 21*a* respectively provided in the side surfaces (first surface portions) 20A and 21A of the left and right side plates 20 and 21, and then screws 23*b* serving as fastening members are threadedly inserted from the side surfaces for fastening, so that the optical stay 23 is fixed to the left and right side plates 20 and 21 while extending substantially parallel to the bottom plate 24. Accordingly, the span between the left and right side plates 20 and 21 in the upper portion in the foreground of FIG. 3 is determined.

Figure 3:
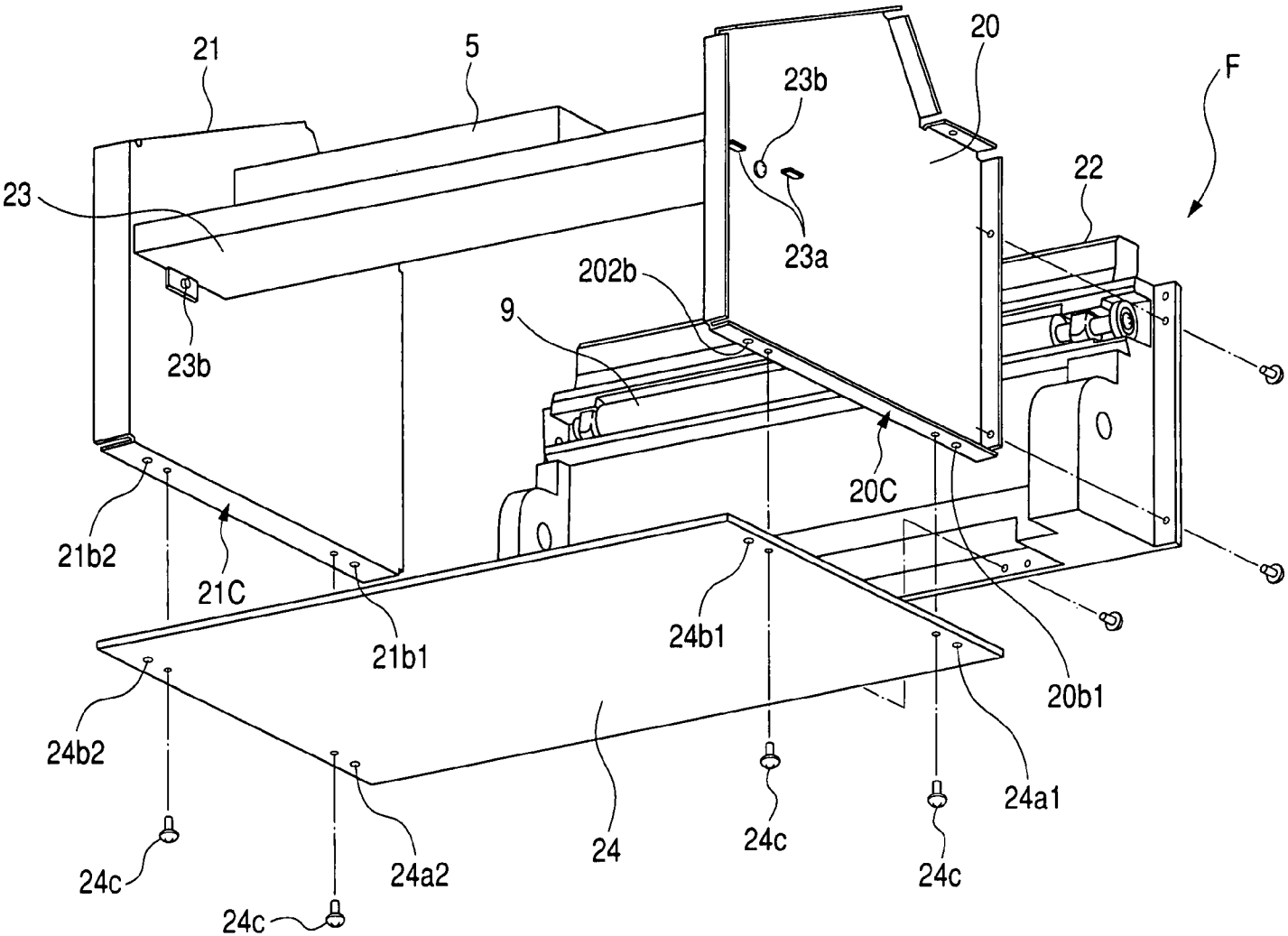
FIG. 3 is a view illustrating how a bottom plate and a conveying member are attached.

Then, as shown in FIG. 3, positioning protrusions 20*b*1 and 20*b*2, and positioning protrusions 21*b*1 and 21*b*2, which are respectively provided on the lower surfaces (third surface portions) 20C and 21C of the left and right side plates 20 and 21, are respectively fitted in a positioning hole 24*a*1 and an elongate hole 24*b*1, and a positioning hole 24*a*2 and an elongate hole 24*b*2, which are respectively provided on the left and right sides of a first surface portion 24A of the bottom plate 24, with screws 24*c* being threadedly inserted for fastening in this state. Accordingly, the span between the left and right side plates 20 and 21 on the lower side is maintained, and the side plates 20 and 21 are arranged upright on the bottom plate 24 while extending parallel to each other.

Figure 4:
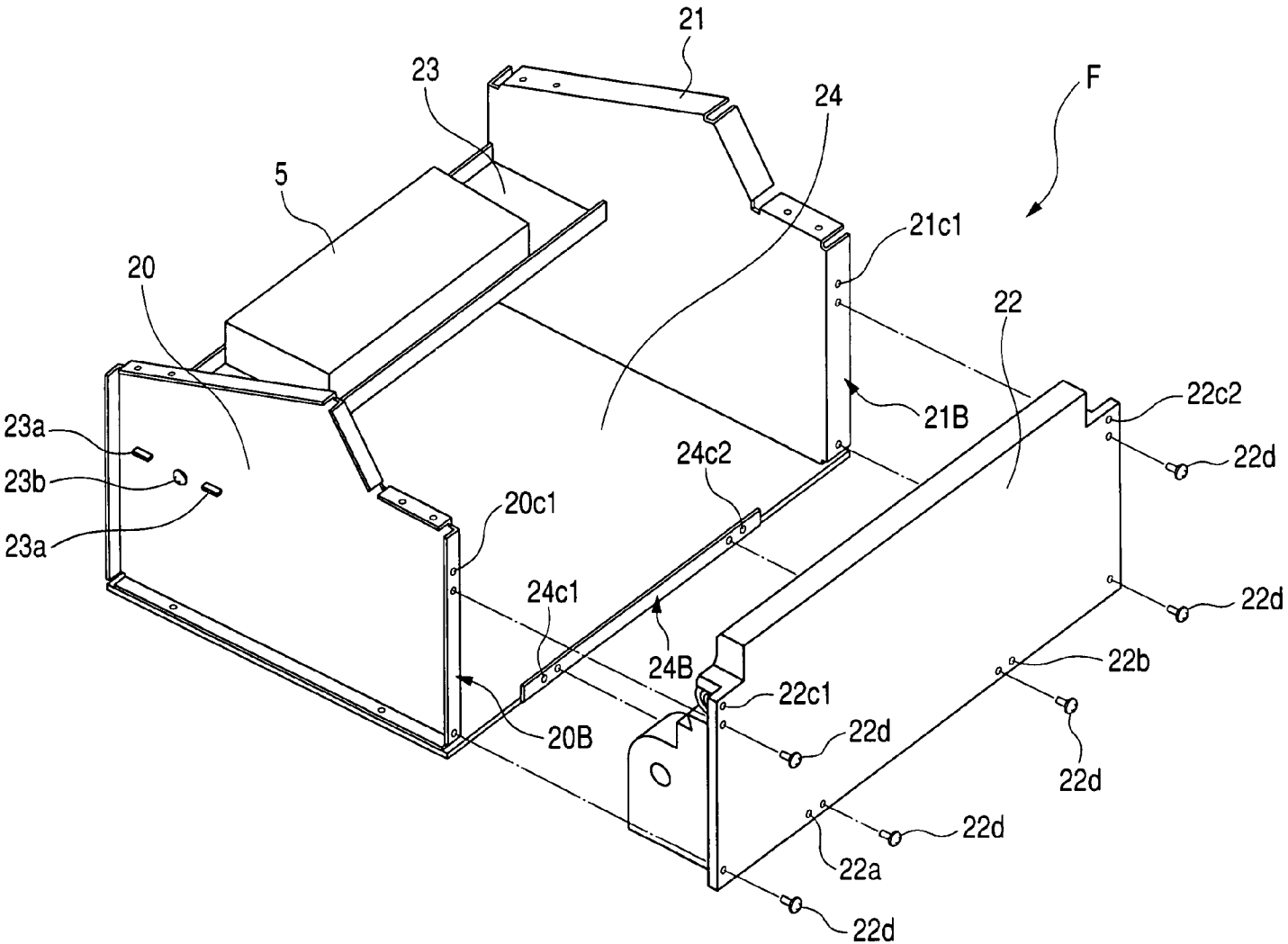
FIG. 4 is a view illustrating how the conveying member is attached.

Then, as shown in FIG. 4, the conveying member 22 is joined to the side plates 20 and 21 and to the bottom plate 24. As a result, the optical stay 23 for positioning and fixing the optical means 5 in place and the conveying member 22 are opposed to each other at a substantially right angle.

When joining the conveying member 22 to the side plates 20 and 21 and to the bottom plate 24, respective positioning holes 20*c*1 and 21*c*1 provided in the second surface portions 20B and 21B of the side plates 20 and 21 are fitted in fitting holes 22*c*1 and 22*c*2 of the conveying member 22, respectively, and positioning protrusions 24*c*1 and 24*c*2 (see FIG. 4), which are formed in an upright wall constituting a second surface portion 24*b* of the bottom plate 24, are fitted in a fitting hole 22*a* and an elongate hole 22*b* of the conveying member 22, respectively, with screws 22*d* being threadedly inserted for fastening in this state.

Figure 5:
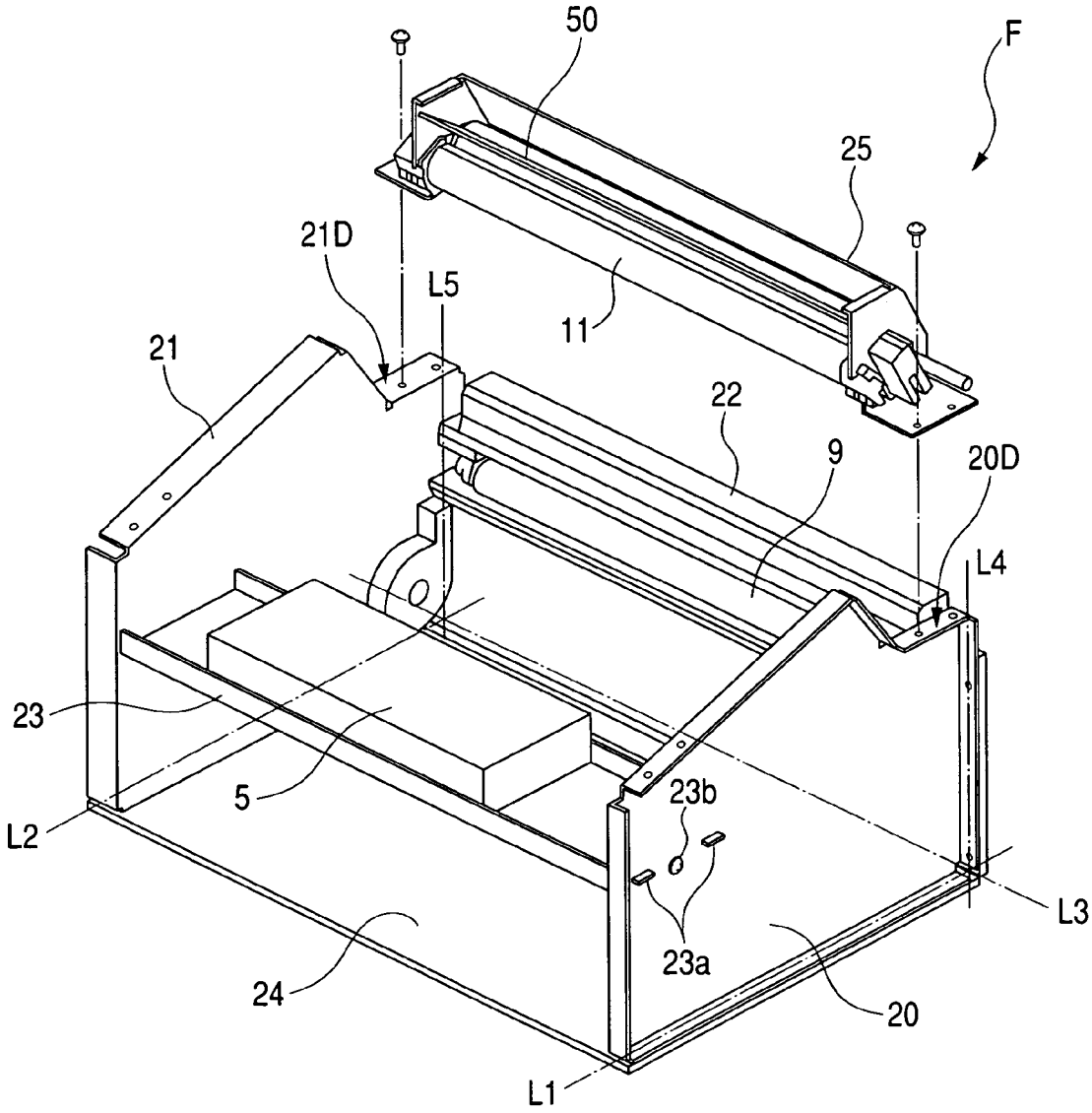
FIG. 5 is a view illustrating how a fixing device is attached.

Accordingly, the main frame F is formed by joining the four plates shown in FIG. 5, that is, the left and right side plates 20 and 21, the bottom plate 24, and the conveying member 22 in joint planes containing abutment lines (edge lines) L1 to L5. In FIG. 4, the optical stay 23 connects between the left and right side plates at the middle portion in the vertical direction thereof.

Accordingly, the requisite rigidity of the main frame F can be secured. To this main frame F, the fixing device 11 supported to the fixing frame 25 is fixed above the conveying member 22, thus assembling main structural portions of the image forming apparatus (FIG. 5). The fixing frame 25 is attached to the fourth surface portions 20D and 21D of the side plates 20 and 21 at a position above the conveying member 22, thus connecting between the two side plates to thereby enhance the rigidity of the main frame F.

In this embodiment, the convey path R for the recording material is arranged along the outer periphery of the laser beam printer I, thus increasing and securing the distance required of the convey path R while reducing the overall size of the apparatus, whereby the main frame F can be accommodated compactly in a confined space. As the main frame F is reduced in size, the torsional rigidity of single parts increases, and further, the intervals at their joining portions narrow, making it possible to attain enhanced rigidity after the joining of the parts as well. Further, a reduction in size also contributes to reducing parts cost.

In this embodiment, the main frame F is formed by successively attaching the optical stay 23, the bottom plate 24, the conveying member 22, and the fixing frame 25 onto the side plates 20 and 21, all in directions different from one another.

Therefore, according to the present invention, the frame is formed by attaching the conveying member 22, the connecting member (optical stay) 23, and the bottom plate 24 onto the side plates 20 and 21 in directions different from one another, whereby at least three kinds of attaching forces differing in the direction of application act on the side plates 20 and 21 through the intermediation of the conveying member 22, the connecting member 23, and the bottom plate 24.

That is, the force acting between the conveying member 22 and the side plates 20 and 21 when the conveying member 22 is attached onto the side plates 20 and 21, the force acting between the connecting member 23 and the side plates 20 and 21 when the connecting member 23 is attached onto the side plates 20 and 21, and the force acting between the bottom plate 24 and the side plates 20 and 21 when the bottom plate 24 is attached onto the side plates 20 and 21 are generated in directions different from one another with respect to the side plates. Therefore, with the frame structure of the image forming apparatus of the present invention, the side plates are applied with forces acting in a plurality of directions, with those forces serving to aid in enhancing the rigidity of the frame including the side plates, the conveying member, the connecting member, and the bottom plate.

Accordingly, there is no need to effect positioning on a plurality of members to be joined at once, making it possible to perform assembling without using dedicated assembling tools. Further, the bottom plate 24, the conveying member 22, and the fixing device 11 are all attached in different directions, which means that those members may be removed independently after assembling the main frame F, facilitating maintenance and repair. Further, the rigidity of the frame is maintained even when one of the conveying member 22, the connecting member 23, and the bottom plate 24 is removed for maintenance or repair, thus causing no problem in performing maintenance and repair.

Accordingly, when defects occur in the convey rollers 3*a* and 3*b* or the sheet feeding roller 2 mounted to the conveying member 22 or when defects occur in the conveying member 22 itself, the conveying member 22 can be removed for performing repair or exchange of the defective parts, thus facilitating maintenance of the image forming apparatus.

Figure 6:
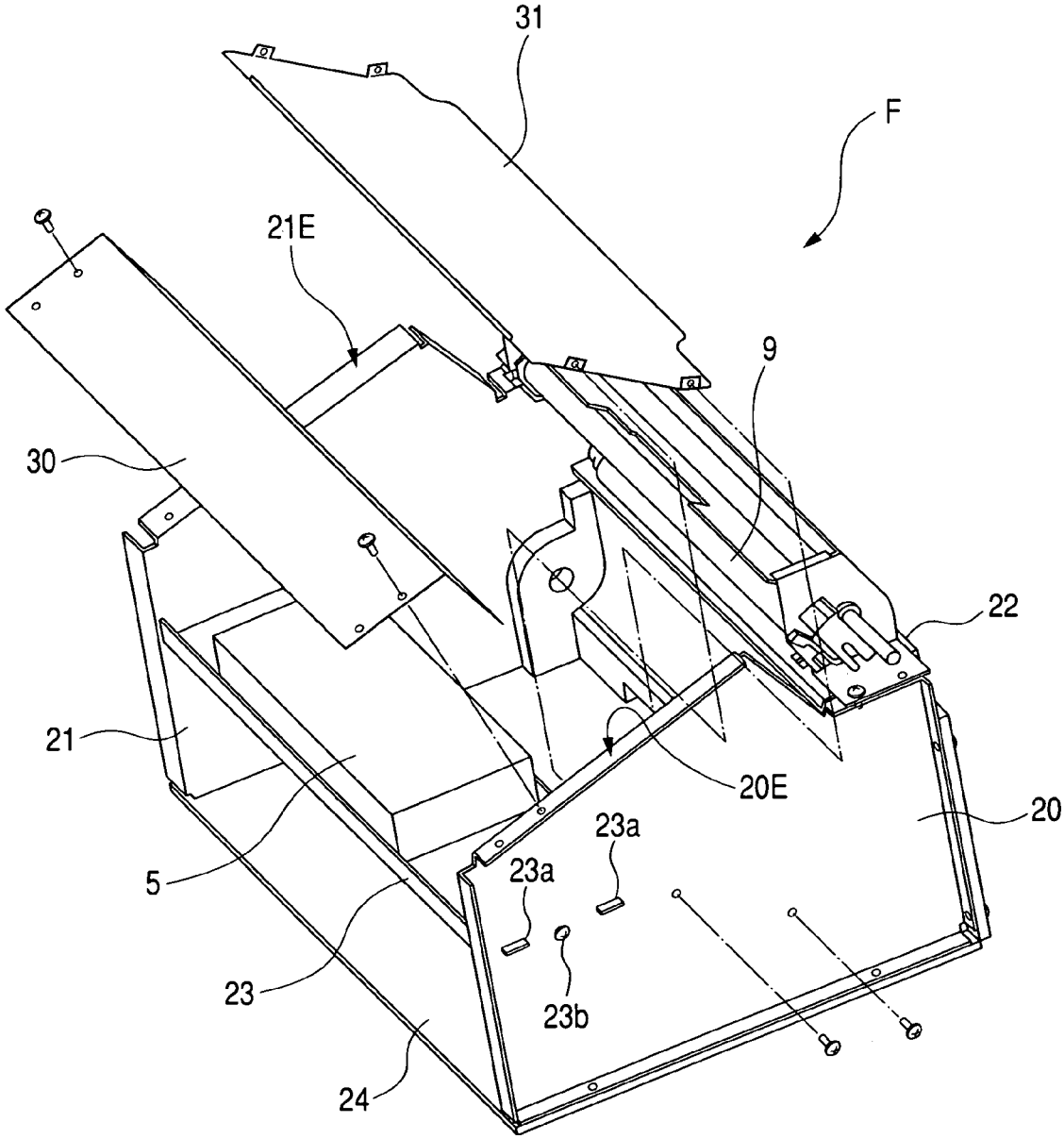
FIG. 6 is a view illustrating how a reinforcing stay is attached.
Figure 7:
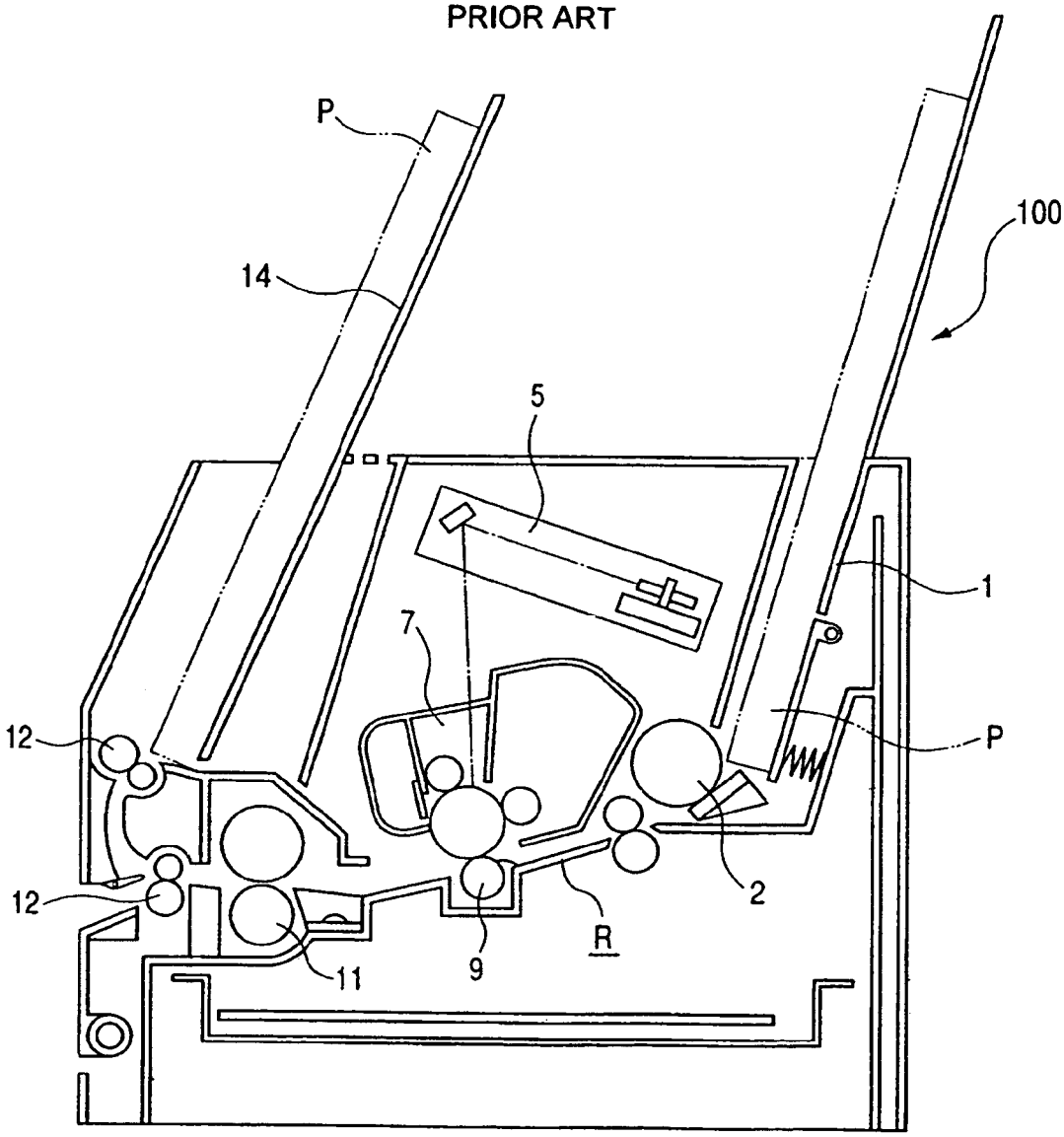
FIG. 7 PRIOR ART
FIG. 7 is a cross sectional view of a conventional image forming apparatus.
Figure 8:
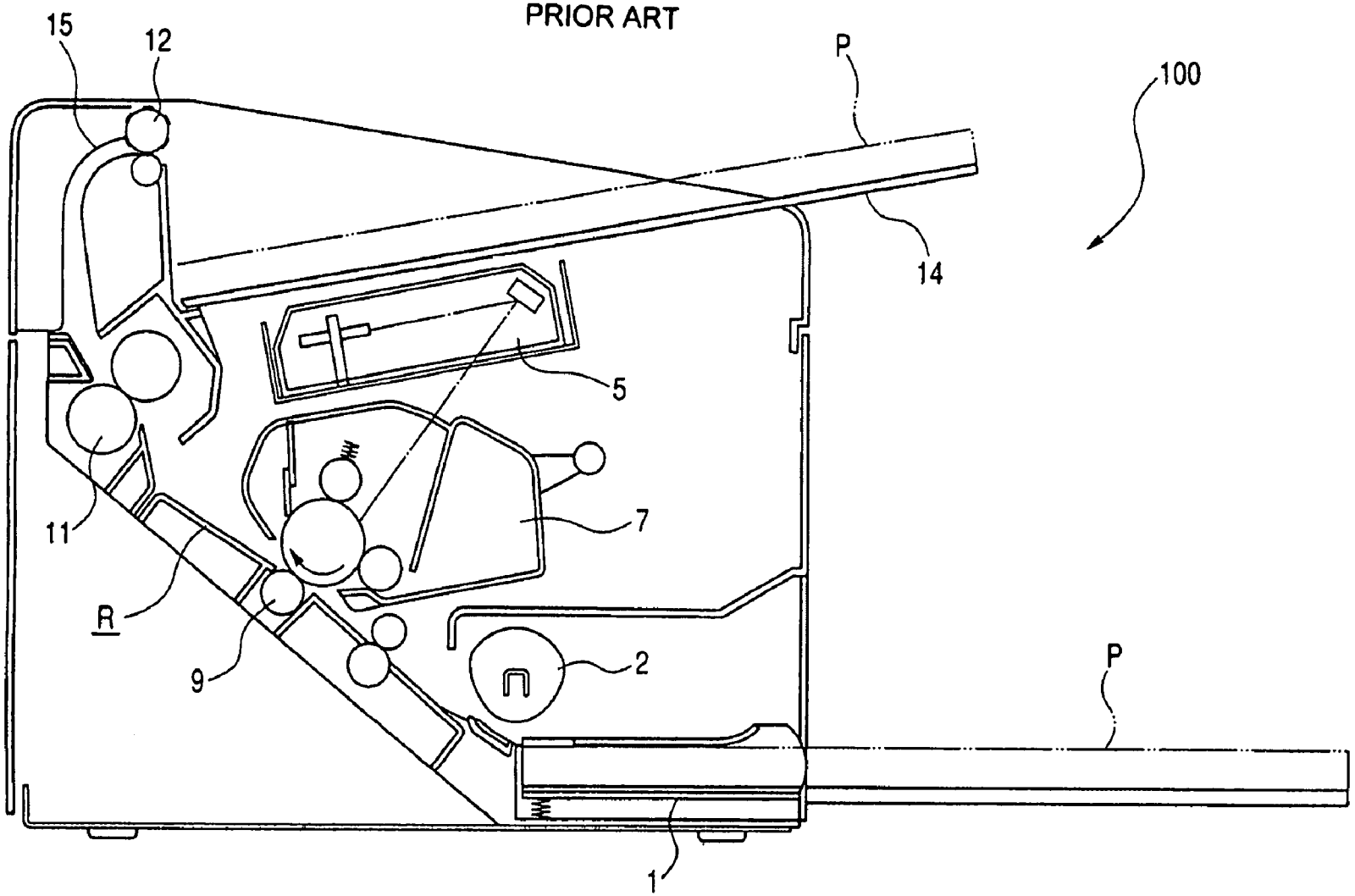
FIG. 8 PRIOR ART
FIG. 8 is a cross sectional view of another conventional image forming apparatus.
Figure 9:
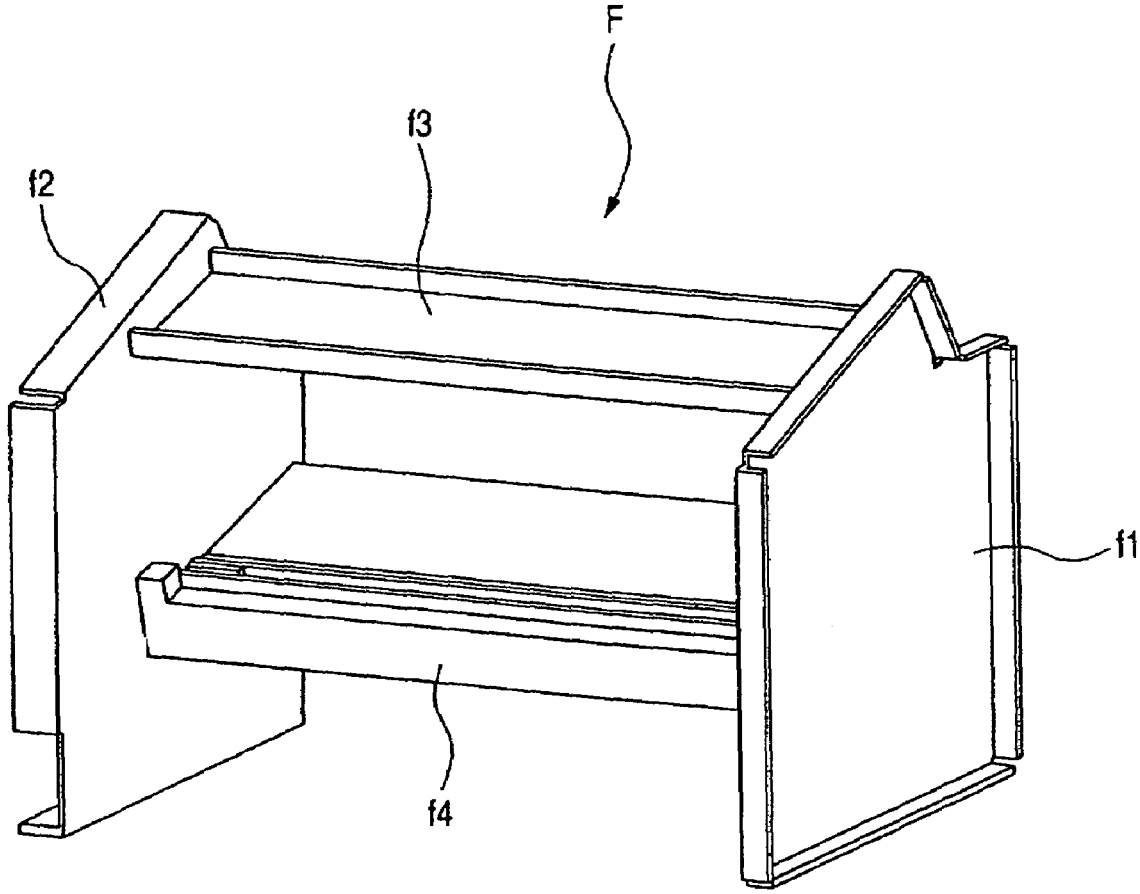
FIG. 9 PRIOR ART
FIG. 9 is a perspective view of a conventional main frame.
Figure 10:
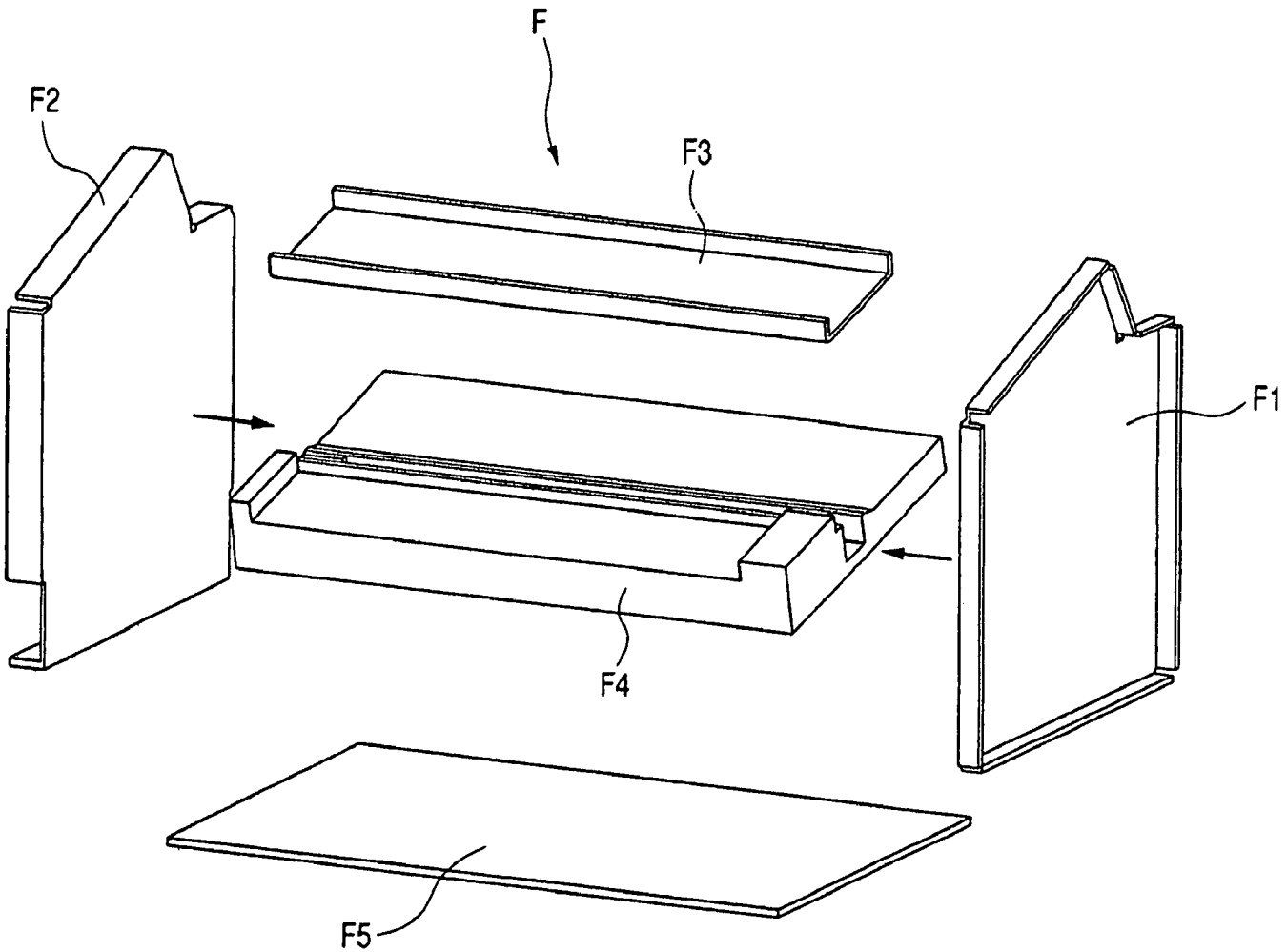
FIG. 10 PRIOR ART
FIG. 10 is an exploded perspective view of another conventional main frame.

Further, when a disturbance is applied to the image forming apparatus and the resulting vibrations are transmitted to the laser scanner 5, the exposure position on the surface of the photosensitive member 8 of the process cartridge 7 changes, which may cause blurring of the latent image formed on the photosensitive member 8. For this reason, it is preferable to impart high mechanical strength to the portion in the vicinity of the portion where the laser scanner 5 is attached. To this end, as shown in FIG. 1 or 6, an auxiliary stay 30 (see FIG. 1 or 6) for assisting the connection between the side plates 20 and 21 is provided to the optical stay 23 so as to cover the laser scanner 5, and is fixed to the respective fifth surface portions 20E and 21E of the left and right side plates 20 and 21 at a position above the laser scanner 5. Thus, the rigidity can be enhanced in the portion in the vicinity of the laser scanner 5. In other words, the auxiliary tray serves as a reinforcing stay, and arranging the auxiliary stay 30 between the two side plates can further enhance the rigidity of the main frame F.

Here, when a construction is adopted in which the process cartridge 7 can be seen from the exterior by opening a cover 60 at the position of the sheet feeding tray 1, the photosensitive member in the process cartridge is exposed to light during operation of the apparatus, and this adversely affects the latent image formation.

Therefore, the process cartridge 7 must be shut off from the outside in the interior portion of the image forming apparatus. In view of this, an intermediate plate 31 (see FIG. 1 or 6) is provided so as to extend from the portion of the optical stay 23 opposed to the conveying member 22 toward the sheet feeding roller 2 in order to shut off light entering from the opening at the sheet feeding tray 1, thus protecting the photosensitive member 8 of the process cartridge 7. When joined to the left and right side plates, the intermediate plate 31 can function as a member (reinforcing stay) for effecting reinforcement on the main frame F from the upper side in the foreground to the lower side in the background of the figure, making it possible to enhance the torsional rigidity of the main frame F.

Further, the conveying member 22 is attached onto the end portions of the side plates 20 and 21, whereby the conveying member 22 can be readily removed, facilitating maintenance or repair. The conveying member 22 functions as the convey path R, beginning at the position of the recording material supplying means and extending by way of the transferring roller 9 to reach the fixing device 11; assuming that the height length from the bottom plate 24 to the fixing device 11 is the same, as compared with the case where the conveying member is obliquely arranged, the conveying member 22 of this embodiment is arranged substantially vertically with respect to the bottom plate 24 and hence the length of the convey path R from the sheet feeding roller 2 to the fixing device 11 is naturally smaller. That is, the requisite amount of the material forming the conveying member 22 may be that much less. In addition, the reduced length of the convey path means that the size of the guide for conveying the recording material may be made that much smaller. Therefore, the number of parts can be reduced, achieving a reduction in cost.

Further, only the conveying member 22, which is required to provide electrical insulating property and slidability with respect to the recording material P, is molded from resin, and the side plates 20 and 21, the bottom plate 24, the optical stay 23, and the fixing frame 25 are formed of sheet metal, whereby it is possible to suppress an increase in cost.

The fixing frame may be joined to the pair of side plates in a direction different from directions in which the conveying member, the connecting member, and the bottom plate are attached onto the pair of side plates.

While the embodiment of the present invention has been described in the foregoing, it is to be understood that the present invention is by means limited to the specific embodiment described above but allows any modifications without departing from the technical idea of the present invention.

This application claims priority from Japanese Patent Application No. 2003-307837 filed Aug. 29, 2003, which is hereby incorporated by reference herein.

What is claimed is:

1. An image forming apparatus comprising:

conveying means for conveying a recording material on which an image is formed;

a pair of side members provided at both sides of the recording material conveyed by said conveying means;

a connecting member for connecting said pair of side members to each other; and a bottom member provided at a bottom of the image forming apparatus;

wherein each side member of said pair of side members has a first surface portion, a second surface portion different from said first surface portion, and a third surface portion different from said first surface portion and said second surface portion, wherein said first surface portions of said pair of side members are opposed with each other, and wherein said connecting member is provided on said first surface portion of each of said pair of side members, wherein said conveying means is provided on said second surface portion of each of said pair of side members, wherein said bottom member is provided on said third surface portion of each of said pair of side members, and wherein said conveying means is made of resin, and said pair of side members, said connecting member, and said bottom member are each made of metal.

2. An image forming apparatus according to claim 1, wherein said conveying means has a rotating member for conveying the recording material.

3. An image forming apparatus according to claim 2, wherein said rotating member is a supply roller for supplying the recording material.

4. An image forming apparatus according to claim 2, wherein said rotating member is a convey roller for conveying the recording material.

5. An image forming apparatus according to claim 2, wherein said rotating member is a transferring roller for transferring an image to the recording material.

6. An image forming apparatus according to claim 5, wherein the resin, which said conveying means is made of, has an electrical insulating property.

7. An image forming apparatus according to claim 1, wherein said conveying means guides movement of the recording material.

8. An image forming apparatus according to claim 1, further comprising:

containing means for containing a recording material; and fixing means for fixing an image to the recording material, wherein said conveying means extends from said containing means to said fixing means.

9. An image forming apparatus according to claim 1, wherein said conveying means is fixed to said second surface portion of each of said pair of side members with a fastening means.

10. An image forming apparatus according to claim 9, wherein said fastening means comprises a screw.

11. An image forming apparatus according to claim 1, wherein said pair of side members are a pair of side plates.

12. An image forming apparatus according to claim 1, wherein said first surface portion, said second surface portion, and said third surface portion are substantially orthogonal to one another.

13. An image forming apparatus according to claim 1, wherein said conveying means, said connecting member, and said bottom member are attached to each of said pair of side members in directions different from one another.

14. An image forming apparatus according to claim 1, wherein said conveying means is arranged in a substantially vertical direction.

* * * * *